US008382538B1

(12) United States Patent
Williams

(10) Patent No.: US 8,382,538 B1
(45) Date of Patent: Feb. 26, 2013

(54) HYDRAULIC THRUSTER FOR VESSEL

(76) Inventor: John T. Williams, Deland, FL (US)

( * ) Notice: Subject to any disclaimer, the term of this patent is extended or adjusted under 35 U.S.C. 154(b) by 201 days.

(21) Appl. No.: 12/806,274

(22) Filed: Aug. 9, 2010

Related U.S. Application Data

(63) Continuation-in-part of application No. 12/800,026, filed on May 6, 2010, which is a continuation-in-part of application No. 12/381,245, filed on Mar. 10, 2009, now Pat. No. 7,883,384, which is a continuation-in-part of application No. 11/999,531, filed on Dec. 6, 2007, now Pat. No. 7,654,875.

(60) Provisional application No. 60/903,400, filed on Feb. 26, 2007.

(51) Int. Cl.
*B63H 21/12* (2006.01)

(52) U.S. Cl. ..... 440/5; 114/151

(58) Field of Classification Search ..... 440/5, 6, 440/61 A, 61 R; 114/150, 151
See application file for complete search history.

(56) References Cited

U.S. PATENT DOCUMENTS

| | | | |
|---|---|---|---|
| 583,740 | A | 6/1897 | Fryer |
| 2,486,049 | A | 10/1949 | Miller |
| 2,766,715 | A | 10/1956 | Waterval |
| 2,936,730 | A | 5/1960 | Patty, Jr. |
| 3,010,424 | A | 11/1961 | Peterson et al. |
| 3,139,062 | A | 6/1964 | Keefe |
| 4,358,280 | A | 11/1982 | Jeanson et al. |
| 4,645,463 | A | 2/1987 | Arneson |
| 4,848,702 | A | 7/1989 | Riggins |
| 4,878,864 | A | 11/1989 | Van Bentem |
| 5,249,378 | A | 10/1993 | Frame |
| 5,476,400 | A | 12/1995 | Theophanides |
| 6,234,854 | B1 | 5/2001 | Rydzewski |
| 6,375,524 | B1 | 4/2002 | Commandeur et al. |
| 6,409,556 | B1 | 6/2002 | Vance |
| 6,672,236 | B1 | 1/2004 | Pinsof |
| 6,799,528 | B1 | 10/2004 | Bekker |
| 6,814,636 | B2 | 11/2004 | Nolen |
| 7,163,427 | B1 | 1/2007 | Lee |
| 2007/0087638 | A1 | 4/2007 | Dulgur |

OTHER PUBLICATIONS

Jan. 8, 2010, Dynamic Sealing Technologies Inc. Dwg. No. HY-08405.
Parker Cat. HY08-1137-3/NA pp. 2, 15.
BEI Duncan Electronics 9360 Series Rotary Hall Effect Sensor descriptive bulletin.
Balluff BTL6-A500/B50 User's Guide pp. 1-3.
Electro-Sensors 906/906B and 907/907B Hall Effect Sensors descriptive bulletin.
Electro-Sensors Pulser Wraps descriptive bulletin.

*Primary Examiner* — Lars A Olson
(74) *Attorney, Agent, or Firm* — Paul S. Rooy PA

(57) ABSTRACT

A hydraulic thruster for vessel. The hydraulic thruster is intended for incorporation into a modular vessel thruster system, and is easily installed onto, and removed from, a vessel having such system. A housing is tiltably attached to a bracket, which in turn is removably mounted to a vessel. A cylinder is rigidly attached to the housing, and a tube is extensibly and rotatably disposed within the cylinder. A thrust means is disposed at a lower end of the tube. The instant thruster incorporates positive redundant down-tilt stop means, increased extension/retraction range, reduced shipping size, and means for securely and removably attaching the thruster to a vehicle deck.

32 Claims, 6 Drawing Sheets

HYDRAULIC THRUSTER FOR VESSEL

CLAIM FOR PRIORITY

This utility patent application is a Continuation-In-Part U.S. utility application Ser. No. 12/800,026 filed May 6, 2010 entitled Modular Hydraulic Thruster System for Vessel, which is a Continuation-In-Part of U.S. utility application Ser. No. 12/381,245 filed Mar. 10, 2009 now U.S. Pat. No. 7,883,384 entitled Self-Contained Hydraulic Thruster for Vessel, which is a Continuation-In-Part of U.S. utility application Serl. No. 11/999,531 filed Dec. 6, 2007 now U.S. Pat. No. 7,654,875 entitled Self-Contained Hydraulic Thruster for Vessel, which was based upon U.S. provisional patent application Serl. No. 60/903,400 filed Feb. 26, 2007 entitled Self-Contained Hydraulic Thruster for Vessel; and claims the benefit of the earlier filing date of these applications.

BACKGROUND OF THE INVENTION

1. Field of the Invention

This invention relates to vessel propulsion systems, and in particular to a hydraulic thruster for vessel.

2. Background of the Invention

Marine thrusters typically mount on barges and flat boats, and are used as propulsion for these vessels. One type of marine thruster employs a prime mover such as a diesel engine driving a hydraulic pump, together known as a "power pack", and the resultant pressurized hydraulic fluid may be employed to drive a propeller attached to a lower unit.

One problem with existing marine thruster system designs is the absence of a quick and easy means to add additional thrusters to the system, as required. It would be desirable to provide a hydraulic thruster for vessel which may be readily attached as required to an existing marine hydraulic thruster system for a flat vessel, as required by changed weight loading and/or thruster requirements.

In addition, there are a number of problems with existing marine hydraulic thrusters themselves. One problem is that existing hydraulic marine thrusters can only extend and retract their propellers units around twenty inches. It would be desirable to be able to extend and retract the propeller unit a greater range, in the order of at least four feet, to accommodate deeper vessels and varied thrusting requirements.

Another problem with existing marine hydraulic thrusters is the challenge involved in shipping them. It would be desirable to provide a marine hydraulic thruster which can fold into a compact size for shipping, including containerized shipping, without having to disassemble the thruster to reduce its shipping cube.

Still another problem associated with currently-available marine thrusters is the absence of a secure down-stop when the thruster is tilted completely down. Accordingly, it would be advantageous to provide positive, redundant down-stops to securely prevent further tilting of a fully down-tilted thruster when it is developing full forward thrust.

Yet another problem associated with existing marine hydraulic thrusters is the absence of a means of securely fastening a thruster to the deck of a vessel upon which it is to be mounted, short of physically welding the thruster base directly to the vessel deck.

Therefore, it would be desirable to provide a hydraulic thruster for vessel which may be readily attached as required to an existing marine hydraulic thruster system for a flat vessel, which is extendible over a significantly greater range than existing thrusters, which can fold into a compact size for shipping, whose design incorporates a positive, redundant down-stop, and means of securely and removably mounting the thruster to a vessel.

SUMMARY OF THE INVENTION

Accordingly, it is an object of the present invention to provide a hydraulic thruster for vessel which may be readily attached to an existing marine hydraulic thruster system. Design features allowing this object to be accomplished include a housing tiltably attached to a bracket, a cylinder rigidly attached to the housing, a tube slidably and rotatably attached to the cylinder, and means of removably attaching the bracket to a vessel deck. Advantages associated with the accomplishment of this object include flexibility in adding additional thruster power, and cost savings where unnecessary thruster power is not installed.

It is another object of the present invention to provide a hydraulic thruster for vessel which is capable of extending over a significantly greater range than currently available designs. Design features allowing this object to be accomplished include a tube reciprocating within a cylinder, and externally-mounted extension actuator(s) which provide a significantly greater extension/retraction range than currently available extension actuators. Benefits associated with the accomplishment of this object include flexibility of installation of the instant hydraulic thruster for vessel into vessels of greater than usual depth, and increased flexibility of use.

It is still another object of this invention to provide a hydraulic thruster for vessel which can fold into a compact size for shipping, without having to disassemble the thruster to reduce its shipping size. Design features enabling the accomplishment of this object include a housing tiltably attached to a bracket, a cylinder rigidly attached to the housing, a tube slidably and rotatably attached to the cylinder, and at least one tilt actuator disposed above the bracket, in order to provide a flat-profile for the hydraulic thruster for vessel when it is completely tilted up. Advantages associated with the realization of this object include reduced labor in preparing the hydraulic thruster for vessel for shipping, reduced setup cost after shipping, and reduced shipping cost due to smaller shipping volume.

It is another object of the present invention to provide a hydraulic thruster for vessel having positive, redundant down-stops to securely prevent over-tilting of a fully down-tilted thruster when it is developing forward thrust. Design features allowing this object to be accomplished include a housing which butts up against a pair of bracket-mounted stops when the hydraulic thruster for vessel cylinder and tube are tilted completely down, and at least one housing-mounted down-stop tab which butts against the bracket when the hydraulic thruster for vessel cylinder and tube are tilted completely down. Benefits associated with the accomplishment of this object include more stable and smoother thruster operation and steering.

It is still another object of this invention to provide a hydraulic thruster for vessel having means of securely and removably fastening a thruster to the deck of a vessel upon which it is mounted. Design features enabling the accomplishment of this object include at least one bracket floor brace having bracket floor brace bores sized to slidably admit a weld tab fastener, and a weld tab with a weld tab threaded bore sized to mate with the weld tab fastener. Advantages associated with the realization of this object is the ability to securely and removably bolt the hydraulic thruster for vessel to a deck to which weld tabs have been welded, and the associated flexibility of use.

It is yet another object of this invention to provide a hydraulic thruster for vessel which is economical to produce. Design features allowing this object to be achieved include the use of commercially available elements, and components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Six sheets of drawings are provided. Sheet one contains FIGS. 1 and 2. Sheet two contains FIGS. 3 and 4. Sheet three contains FIG. 5. Sheet four contains FIG. 6. Sheet five contains FIGS. 7 and 8. Sheet six contains FIG. 9.

DETAILED DESCRIPTION OF THE PREFERRED EMBODIMENT

Figure 1:
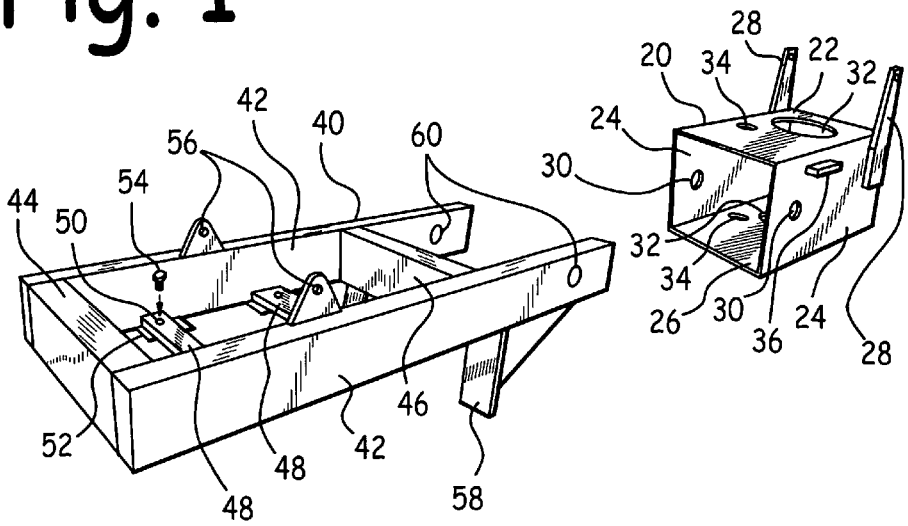
FIG. 1 is a left front elevated isometric view of a bracket and a housing.
Figure 2:
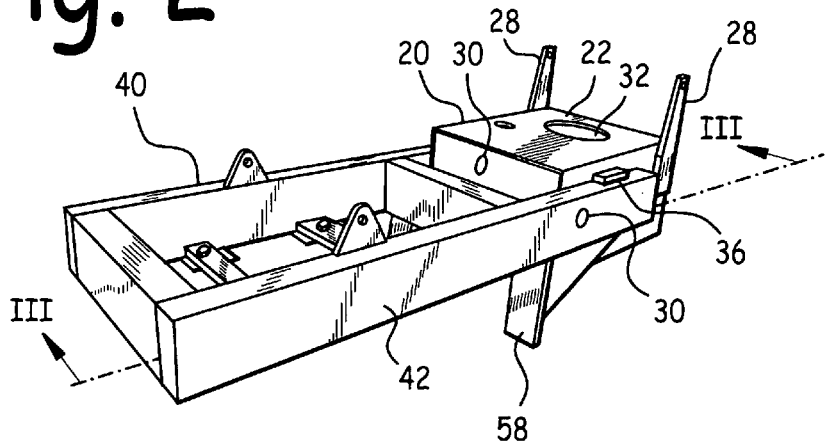
FIG. 2 is a left front elevated isometric view of a housing tiltably attached to a bracket, with the housing tilted down.
Figure 3:
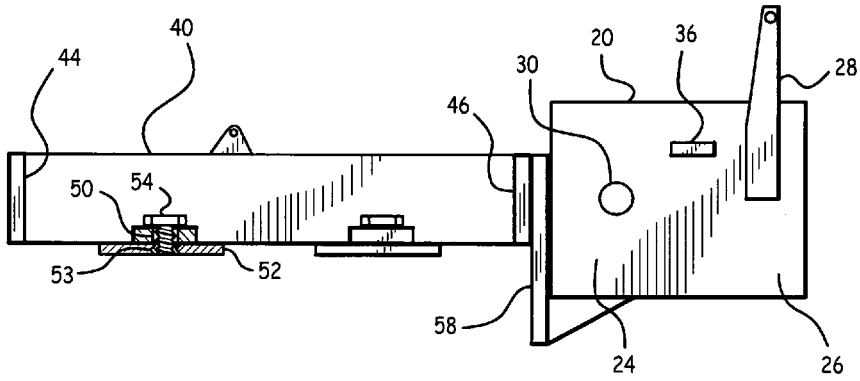
FIG. 3 is a left side cross-sectional view of a housing tiltably attached to a bracket, with the housing tilted down, taken at section of FIG. 2.
Figure 4:
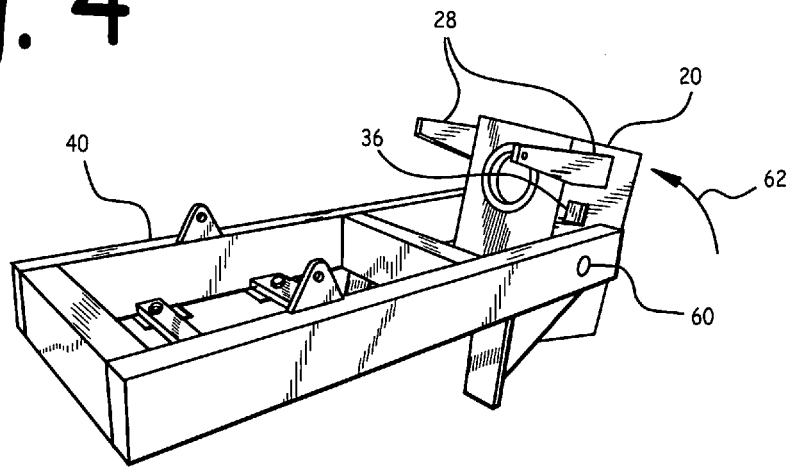
FIG. 4 is a left front elevated isometric view of a housing tiltably attached to a bracket, with the housing tilted up.

FIG. 1 is a left front elevated isometric view of bracket 40 and housing 20. FIG. 2 is a left front elevated isometric view of housing 20 tiltably attached to bracket 40, with housing 20 tilted down. FIG. 3 is a side cross-sectional view of housing 20 tiltably attached to bracket 40, with housing 20 tilted down, taken at section of FIG. 2. FIG. 4 is a left front elevated isometric view of housing 20 tiltably attached to bracket 40, with housing 20 tilted up.

Referring to FIGS. 1-4, housing 20 comprises housing roof 22 rigidly attached to a pair of housing sides 24, which in turn are rigidly attached to housing floor 26. The upper edge of a first housing side 24 is attached along one edge of housing roof 22; the upper edge of a second housing side 24 is attached along an edge of housing roof 22 opposite first housing side 24. The lower edge of first housing side 24 is attached along one edge of housing floor 26; the lower edge of second housing side 24 is attached along an edge of housing floor 26 opposite the first housing side 24.

A cylinder aperture 32 is disposed in housing roof 22 and also in housing floor 26. As may be observed in FIG. 6, cylinder apertures 32 are sized to admit cylinder 70.

An extension actuator aperture 34 is disposed in housing roof 22 and also in housing floor 26. As may be observed in FIG. 9, extension actuator apertures 34 are sized to admit extension actuator 74.

Each housing side 24 contains a housing pivot point 30. A tilt arm 28 is rigidly attached to an end of at least one housing side 24 opposite bracket 40. Each tilt arm 28 extends upwards past housing roof 22 in a direction away from housing floor 26 and substantially perpendicular to housing roof 22.

Figure 5:
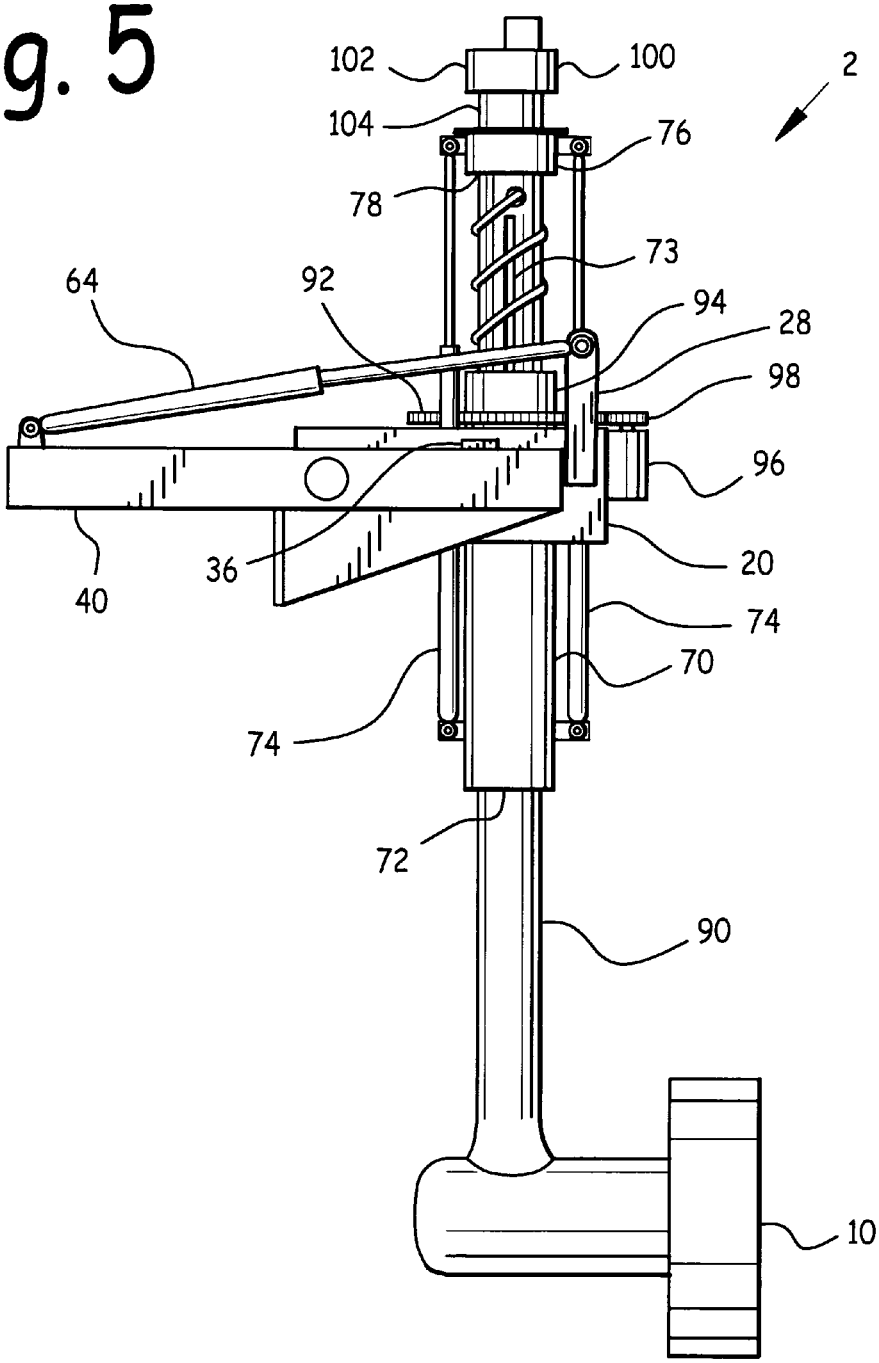
FIG. 5 is a right side view of a hydraulic thruster for vessel.
Figure 6:
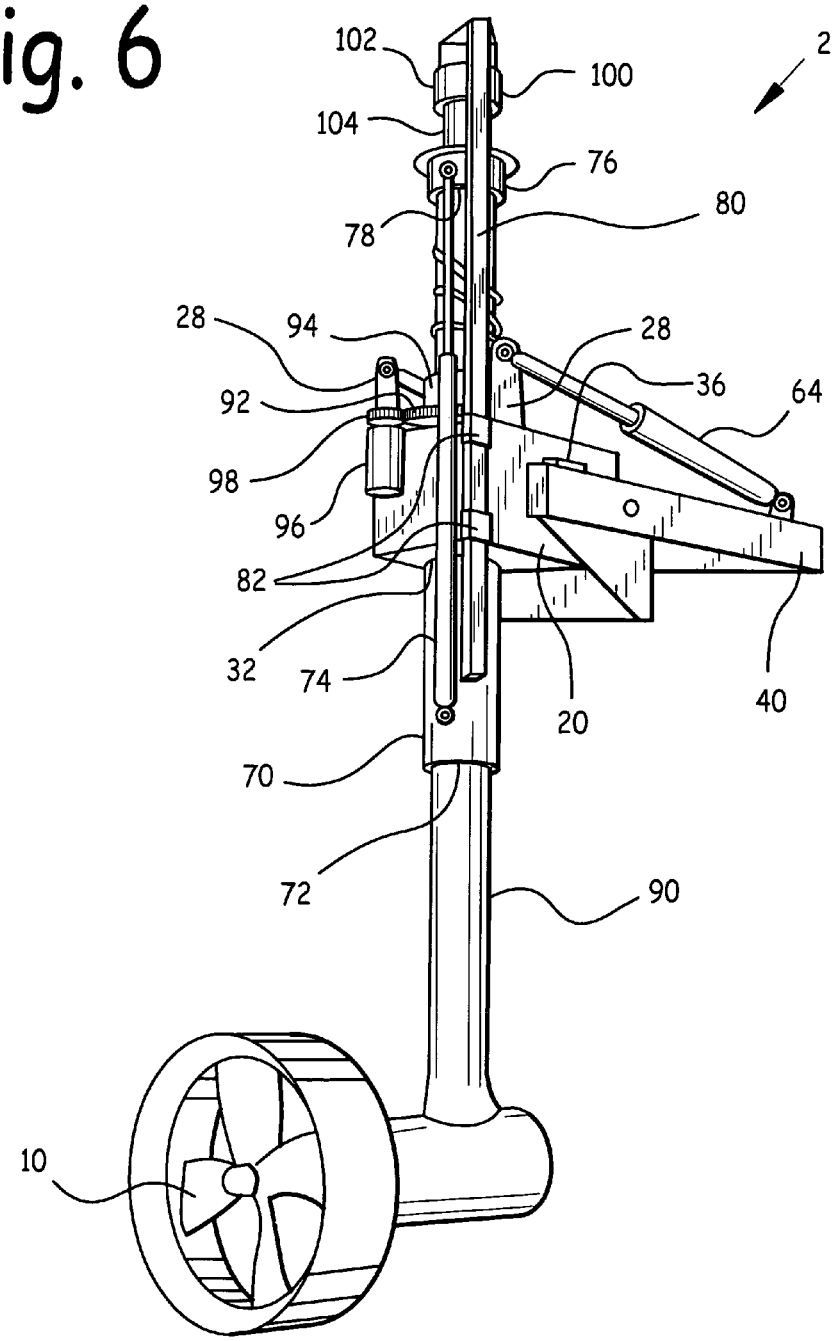
FIG. 6 is a left quarter view of a hydraulic thruster for vessel.

A down-stop tab 36 is attached to at least one housing side 24 between housing pivot point 30 and tilt arm 28. As may be observed in FIG. 2, down-stop tab 36 buts against bracket 40 when housing 20 is tilted fully down, as is also depicted in FIGS. 3, 5 and 6, thus providing a positive end-of-down-tilt-travel stop feature to the instant invention.

As may be observed in FIG. 3, a redundant end-of-down-tilt-travel stop is provided by the forward edge of housing floor 26 and lower edges of each housing wall 24 nearest bracket 40, which butt against stops 58 when housing 20 is tilted fully down. Thus, down-stop tabs 36 and the action of housing floor 26 and housing walls 24 butting against stops 58 provide redundant positive down-tilt stops.

Bracket 40 incorporates a pair of substantially parallel bracket sides 42 mutually attached by bracket front brace 44, bracket rear brace 46, and at least one bracket floor brace 48. One end of bracket front brace 44 is rigidly attached to one end of a first bracket side 42, and the other end of bracket front brace 44 is rigidly attached to one end of a second bracket side 42.

A bracket pivot point 60 is disposed at an end of each bracket side 42 opposite bracket front brace 44. One end of bracket rear brace 46 is rigidly attached to a first bracket side 42 between bracket front brace 44 and bracket pivot point 60, and the other end of bracket rear brace 46 is rigidly attached to a second bracket side 42 between bracket front brace 44 and bracket pivot point 60.

A stop 58 is rigidly attached to a at least one bracket side 42 between bracket pivot point 60 and bracket front brace 44. Each stop 58 extends downwards from, and substantially perpendicular to, the bracket side 42 to which it is attached. When hydraulic thruster for vessel 2 is installed on a vessel, stop(s) 58 butt up against the stern of the vessel, and provide a positive mechanical stop for hydraulic thruster for vessel 2 to exert forward force against the vessel.

One end of each bracket floor brace 48 is rigidly attached to a lower edge of a first bracket side 42 between bracket front brace 44 and stop 58, and the other end of each bracket floor brace 48 is rigidly attached to a lower edge of a second bracket side 42 between bracket front brace 44 and stop 58.

Each bracket floor brace 48 incorporates at least one bracket floor brace bore 50 sized to slidably admit a weld tab fastener 54. Weld tabs 52 serve to attach hydraulic thruster for vessel 2 to a vessel deck to which weld tabs 52 have been attached, e.g. by welding. Each weld tab 52 includes a weld tab threaded bore 53 sized to mate with weld tab fastener 54, as may be more clearly observed in FIG. 3.

In use, weld tabs 52 are attached to respective bracket floor braces 48 by inserting a weld tab fastener 54 through a bracket floor brace bore 50, and then threading and tightening it into a weld tab threaded bore 53. Hydraulic thruster for vessel 2 is then positioned on the deck of a vessel to which it is to be attached, and weld tabs 52 are attached to the vessel deck, e.g. by welding. Hydraulic thruster for vessel 2 can then subsequently be quickly and easily detached from the vessel deck by simply un-screwing weld tab fasteners 54 from their respective weld tabs 52. Hydraulic thruster for vessel 2 can then be removed from the vessel deck, leaving weld tabs 52 in place attached to the deck, ready for later use in re-attaching a hydraulic thruster for vessel 2 to the deck.

Housing 20 is assembled onto bracket 20 by pivotally attaching each housing pivot point 30 to a respective bracket pivot point 60. This may be accomplished via any appropriate pivotal attachment means. In the preferred embodiment, an axle was slid through each housing pivot point 30 and bracket pivot point 60 pair, which were bores.

A bracket tilt actuator attach point 56 corresponding to each tilt arm 28 is disposed on at least one bracket side 42. In order to tilt housing 20 around housing pivot point 30 and bracket pivot point 60 relative to bracket 40, one end of a tilt actuator 64 is rotatably attached to an end of a tilt arm 28 opposite housing 20, and the other end of the tilt actuator 64 is rotatably attached to a respective bracket tilt actuator attach point 56 on a corresponding bracket side 42.

Figure 9:
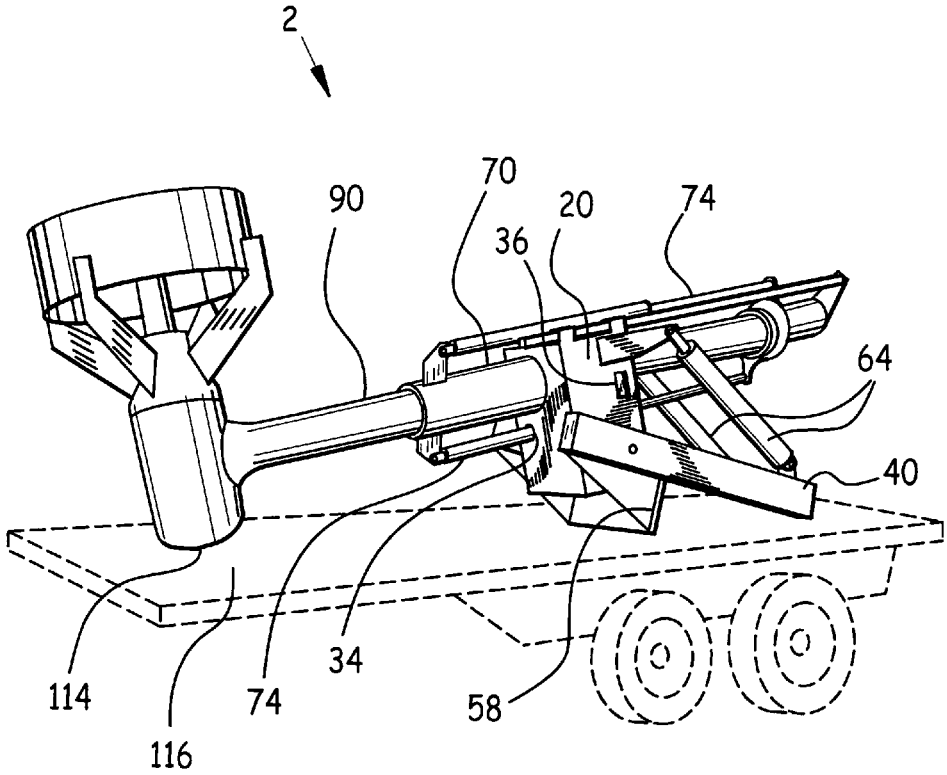
FIG. 9 is a left side view of a hydraulic thruster for vessel with its housing, cylinder, and tube tilted up, and its tube retracted into the minimum-volume shipping configuration.

Housing 20 may then be tilted up as urged by tilt actuator(s) 64 is indicated by arrow 62 in FIG. 4, or down into the down-tilted position depicted in FIGS. 2, 3, 5 and 6. FIG. 9 depicts a hydraulic thruster for vessel 2 in an up-wardly tilted position for shipping. Thus, retraction and extension of tilt actuator 64 causes housing 20 to rotate upwards around housing pivot points 30 and bracket pivot points 60, and downwards around housing pivot points 30 and bracket pivot points 60, respectively.

FIG. 5 is a right side view of hydraulic thruster for vessel 2. FIG. 6 is a left quarter view of hydraulic thruster for vessel 2. FIG. 9 is a left side view of hydraulic thruster for vessel 2 tilted up, with its tube retracted into its minimum-volume shipping configuration.

Referring to these figures, it may be observed that hydraulic thruster for vessel 2 further comprises cylinder 70 installed through cylinder apertures 32 in housing 20, and tube 90 slidably and rotatably installed through cylinder 70 bore 72 in cylinder 70.

Hydraulic thruster for vessel 2 also has at least one extension actuator 74 which permits tube 90 to be extended and retracted relative to cylinder 70. Extension actuator 74 is attached at its lower end to cylinder 70, and at its upper end to collar 76. Collar 76 has collar bore 78 sized to slidably admit tube 90.

In the preferred embodiment, a length of cylinder 70 was substantially 28%-48% the length of tube 90, a height of housing 20 was substantially 5%-20% the length of tube 90, and the retracted length of extension actuator 74 was substantially 26%-46% the length of tube 90. These dimensional relationships permit the instant hydraulic thruster for vessel 2 provide a significantly increased extension/retraction range of tube 90 relative to cylinder 70, thus increasing utility and flexibility of use. Propeller 10 is disposed at a lower end of tube 90, and during operation would be immersed in water and provides thrust.

Because cylinder 70 is installed through cylinder apertures 32 in housing 20 and tube 90 is slidably and rotatably installed through bore 72 in cylinder 70, when housing 20 tilts relative to bracket 40, so also do cylinder 70 and tube 90. Thus, the tilt actuator(s) 64 previously described act to tilt tube 90 up and down relative to bracket 40 and to the vessel to which hydraulic thruster for vessel 2 is mounted.

Swivel union 100 having an upper swivel union stationary section 102 rotatably attached to a lower swivel union rotating section 104 is disposed atop tube 90. Swivel union rotating section 104 is attached to the upper end of tube 90, and rotates with tube 90. Swivel union stationary section 102 is prevented from rotating by means of anti-rotation member 80, an upper end of which is rigidly attached to swivel union stationary section 102. Swivel union 100 includes electronic angle detection means to determine and transmit to an instrument panel via electrical signal the angle between swivel union stationary section 102 and swivel union rotating section 104, thus indicating steering angle of propeller 10.

Anti-rotation member 80 is maintained in constant vertical orientation relative to housing 20 by means of antirotation member guide(s) 82 rigidly attached to housing 20. Each anti-rotation guide 82 is sized to slidably admit anti-rotation member 80. In the preferred embodiment, one anti-rotation member guide 82 was rigidly attached at an upper edge of housing 20, and another anti-rotation member guide 82 was rigidly attached at a lower edge of housing 20.

Because anti-rotation member 80 is free to reciprocate within anti-rotation member guides 82 (which are rigidly attached to housing 20), and because an upper end of anti-rotation member 80 is rigidly attached to swivel union stationary section 102, swivel union 100 is free to rise as urged by collar 76 actuated by extension actuator(s) 74 (while simultaneously being prevented from rotating relative to housing 20 by anti-rotation member 80); and is also free to descend with collar 76 under the influence of gravity when extension actuator(s) 74 are retracted (while simultaneously being prevented from rotating relative to housing 20 by anti-rotation member 80).

Thus, tube 90 is retracted by extension of extension actuator(s) 74, which push both collar 76 and swivel union 100 upwards. Tube 90 is extended by retraction of extension actuator(s) 74, which permits both collar 76 and swivel union 100 to descend under the influence of gravity.

Figure 7:
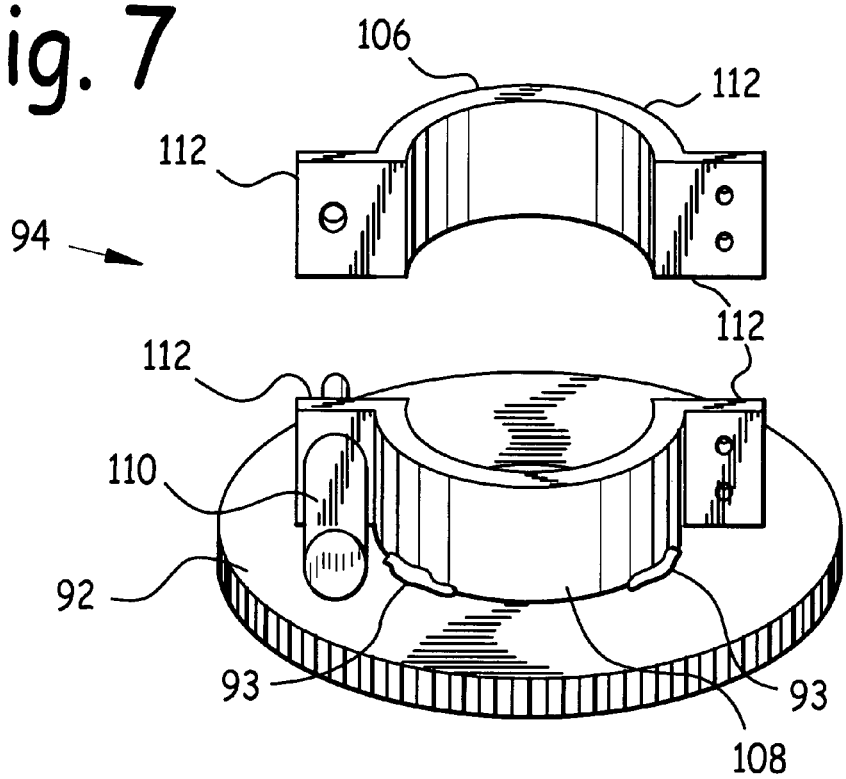
FIG. 7 is a front elevated view of a tube gear clamp, with its tube gear clamp first half unattached from its tube gear clamp second half.

Tube 90 is sized to slidably fit into cylinder bore 72 in cylinder 70. Thus, tube 90 is free to rotate and reciprocate within cylinder 70. Referring now also to FIG. 7, a front elevated view of tube gear clamp 94, with its tube gear clamp first half 106 unattached from its tube gear clamp second half 108; and FIG. 8, a side elevated view of tube gear clamp 94, with its tube gear clamp first half 106 attached to its tube gear clamp second half 108; we observe that reversible steering motor 96 drives steering motor gear 98, which in turn drives tube gear 92. Tube gear 92 is rigidly attached to tube gear clamp second half 108, and steering motor 96 is rigidly attached to housing 20. In the preferred embodiment, tube gear clamp second half 108 was attached to tube gear 92 with welds 93.

Tube gear clamp 94 contains tube gear clamp bore 107, which is sized to slidably admit tube 90. Tube gear clamp key 109 extends into tube gear clamp bore 107, and is sized to slidably reciprocate within tube keyway 73 in tube 90. Tube gear clamp key 109 reciprocating within tube keyway 73 prevents tube 90 from rotating relative to tube gear clamp 94 and tube gear 92. Thus, when steering motor 96 turns tube gear 92 and rigidly attached tube gear clamp 94, tube 90 turns at the same rate, thereby providing a steering function to hydraulic thruster for vessel 2.

The top view shape of tube gear clamp first half 106 and tube gear second half 108 is substantially a 180 degree arc of a circle, with a tube gear clamp flange on each end. When mounted to tube 90, tube gear clamp first half 106 and tube gear second half 108 are emplaced around tube 90 such that tube 90 is slidably disposed within tube gear clamp bore 107. Then a tube gear clamp first half flange 112 is attached to a corresponding tube gear second half 108 flange 112 (using fasteners such as bolts, in the preferred embodiment), as depicted in FIG. 8.

Figure 8:
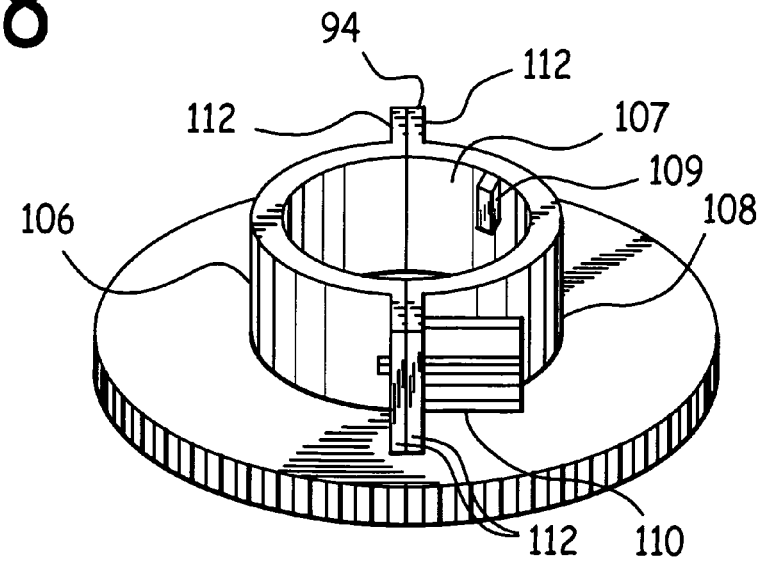
FIG. 8 is a side elevated view of a tube gear clamp, with its tube gear clamp first half attached to its tube gear clamp second half.

Tube gear clamp actuator 110 is mounted to one of the two remaining unattached flanges 112, and its actuator attached to the other remaining unattached flanges 112, as depicted in FIG. 8. Tube gear clamp actuator 110 serves to loosen and tighten tube gear clamp 94 on tube 90. Tube gear clamp 94 must be loosened, or opened, prior to extending or retracting tube 90 within cylinder 70, and tube gear clamp actuator 110 permits the opening and closing of tube gear clamp 94 to be accomplished remotely.

Following extension or retraction of tube 90, tube gear clamp 94 must be closed or tightened, in order to help prevent tube 90 from rotating within tube gear clamp 94 while steering, and to lock tube 90 into position relative to cylinder 70 axially.

FIG. 9 is a side view of hydraulic thruster for vessel 2 tilted up, with its tube 90 retracted relative to cylinder 70 into its minimum-volume shipping configuration. As may be observed in this depiction, in this configuration hydraulic thruster for vessel 2 rests horizontally on its propeller case 114, stops 58, and the front end of bracket 40. In this shipping configuration, hydraulic thruster for vessel 2 can be easily rolled into a shipping container, shipped tied down to a flat-bed truck 116, trailer or barge, etc.

The ability for hydraulic thruster for vessel 2 to tilt and retract into the shipping configuration depicted in FIG. 9 depends in part on the location of tilt actuator(s) 64 atop bracket 40, which avoids the necessity of risking shipping hydraulic thruster for vessel 2 while resting on tilt actuator(s) 64, or in the alternative incurring the labor expense of removing and re-installing these before and after shipping. In addition, no dis-assembly and re-assembly of the instant hydraulic thruster for vessel 2 are required before and after shipping, and the overall height and cube of hydraulic thruster for vessel 2 are reduced compared to the designs currently available, which reduces shipping labor and cost.

In the preferred embodiment, the structural components of housing 20, bracket 40, tube 90 and cylinder 70 were made of metal, synthetic, or other appropriate material. Steering motor 96, swivel union 100, collar 76, tube gear 92, steering motor gear 98, tube gear clamp 94, tilt actuator 64, extension actuator 74, and propeller 10 were commercially available items. While a propeller is illustrated as the thrust means in the drawings, it is intended to fall within the scope of this disclosure that propeller 10 be any appropriate thrust means, including but not limited to jet thrust, ducted fan, water jet, boat propeller, etc.

In the preferred embodiment, tilt actuator 64 and extension actuator 74 were hydraulic actuators powered by pressurized hydraulic fluid, although it is intended to fall within the scope of this disclosure that these elements be any appropriate actuator, including but not limited to electrical actuators, solenoids, linear motors, rack-and-pinion gear arrangements, etc. Similarly, in the preferred embodiment steering motor 96 was a hydraulic motor, but it is intended to fall within the scope of this disclosure that this elements be any appropriate motor, including electrical, etc.

While a preferred embodiment of the invention has been illustrated herein, it is to be understood that changes and variations may be made by those skilled in the art without departing from the spirit of the appending claims.

DRAWING ITEM INDEX

2 hydraulic thruster for vessel
10 propeller
20 housing
22 housing roof
24 housing side
26 housing floor
28 tilt arm
30 housing pivot point
32 cylinder aperture
34 extension actuator aperture
36 down-stop tab
40 bracket
42 bracket side
44 bracket front brace
46 bracket rear brace
48 bracket floor brace
50 bracket floor brace bore
52 weld tab
53 weld tab threaded bore
54 weld tab fastener
56 bracket tilt actuator attach point
58 stop
60 bracket pivot point
62 arrow
64 tilt actuator
70 cylinder
72 cylinder bore
73 tube keyway
74 extension actuator
76 collar
78 collar bore
80 anti-rotation member
82 anti-rotation member guide
90 tube
92 tube gear
93 weld
94 tube gear clamp
96 steering motor
98 steering motor gear
100 swivel union
102 swivel union stationary section
104 swivel union rotating section
106 tube gear clamp first half
107 tube gear clamp bore
108 tube gear clamp second half
109 tube gear clamp key
110 tube gear clamp actuator
112 tube gear clamp flange
114 propeller case
116 flat bed truck

I claim:

1. A hydraulic thruster for vessel comprising a housing tiltably attached to a bracket, a cylinder rigidly attached to said housing, a tube slidably and rotationally disposed within said cylinder, a thrust means at a lower end of said tube, means of tilting said housing relative to said bracket, means of extending and retracting said tube relative to said cylinder, and means of rotating said tube relative to said cylinder, whereby said thrust means may be steered, said housing comprising a housing roof, a first housing side, a second housing side, and a housing floor, an upper edge of said first housing side being attached along one edge of said housing roof, an upper edge of said second housing side being attached along an edge of said housing roof opposite said first housing side, a lower edge of said first housing side being attached along one edge of said housing floor, a lower edge of said second housing side being attached along an edge of said housing floor opposite said first housing side, a cylinder aperture in said housing roof, a cylinder aperture in said housing floor, each said cylinder aperture being sized to admit said cylinder, said cylinder being disposed through said cylinder apertures.

2. The hydraulic thruster for vessel of claim 1 wherein said bracket comprises a first bracket side and a second bracket side mutually attached by a bracket front brace, said first bracket side being substantially parallel to said second bracket side, a bracket rear brace, and at least one bracket floor brace, one end of said bracket front brace being rigidly attached to one end of said first bracket side, and another end of said bracket front brace being rigidly attached to one end of said second bracket side, said housing being tiltably attached to said bracket at bracket pivot points disposed at ends of said first bracket side and said second bracket side opposite said bracket front brace, and a stop rigidly attached to each bracket side between said bracket pivot point and said bracket front brace, each said stop extending downwards from its respective said bracket side in a direction substantially perpendicular to said bracket side.

3. The hydraulic thruster for vessel of claim 2 further comprising redundant down-stop means, said down-stop means comprising a down-stop tab rigidly attached to at least one said housing side, said housing being tiltably attached to said bracket at a housing pivot point at an end of each said housing side closest said bracket, said down-stop tab being disposed between said housing pivot point and an end of said housing side opposite said bracket, whereby each said down-stop tab butts against a respective said bracket side said when said housing is fully tilted down relative to said bracket, and wherein an edge of said housing floor and lower edges of each said housing wall nearest said bracket butt against said at least one stop when said housing is fully tilted down.

4. A hydraulic thruster for vessel comprising a housing tiltably attached to a bracket; a cylinder rigidly attached to said housing; a tube slidably and rotationally disposed within said cylinder; a thrust means at a lower end of said tube; means of tilting said housing relative to said bracket; means of extending and retracting said tube relative to said cylinder; and means of rotating said tube relative to said cylinder, whereby said thrust means may be steered; said housing comprising at least one housing side; said means of tilting said housing relative to said bracket comprising a tilt arm rigidly attached to an end of said at least one said housing side opposite said bracket, said tilt arm extending upwards and substantially perpendicular to an upper edge of said housing side to which it is attached; one bracket tilt actuator attach point on said bracket corresponding to each said tilt arm; and a tilt actuator, one end of said tilt actuator being rotatably attached to said bracket tilt actuator attach point, an opposite end of said tilt actuator being rotatably attached to an end of said tilt arm opposite said housing.

5. The hydraulic thruster for vessel of claim 4 wherein each said bracket tilt actuator attach point is disposed on an upper portion of said bracket, and wherein each said a tilt actuator is disposed above said bracket, whereby said tube, cylinder and housing may be tilted up relative to said bracket, and said tube retracted into said cylinder into a compact shipping configuration.

6. A hydraulic thruster for vessel comprising a housing tiltably attached to a bracket, a cylinder rigidly attached to said housing, a tube slidably and rotationally disposed within said cylinder, a thrust means at a lower end of said tube, means of tilting said housing relative to said bracket, means of extending and retracting said tube relative to said cylinder, and means of rotating said tube relative to said cylinder, whereby said thrust means may be steered, said means of extending said tube relative to said cylinder comprising at least one extension actuator, each said extension actuator being attached at one end to said cylinder and at an opposite end to a collar having a collar bore sized to slidably admit said tube, an end of said tube opposite said thrust means being disposed within said collar bore.

7. The hydraulic thruster for vessel of claim 6 further comprising an extension actuator aperture in said housing roof, and an extension actuator aperture disposed in said housing floor, each said extension actuator aperture being sized to admit said extension actuator, one said extension actuator extending through said housing floor extension aperture and said housing roof aperture, whereby said extension actuator is supported by said extension actuator apertures.

8. A hydraulic thruster for vessel comprising a housing tiltably attached to a bracket, a cylinder rigidly attached to said housing, a tube slidably and rotationally disposed within said cylinder, a thrust means at a lower end of said tube, means of tilting said housing relative to said bracket, means of extending and retracting said tube relative to said cylinder, and means of rotating said tube relative to said cylinder, whereby said thrust means may be steered, said bracket comprising a first bracket side and a second bracket side mutually attached by a bracket front brace, said first bracket side being substantially parallel to said second bracket side, at least one bracket floor brace, at least one weld tab attached to said bracket by means of a weld tab fastener extending through a corresponding bracket floor brace bore and a threadably engaged with a corresponding mating weld tab threaded bore in said weld tab, said weld tab being attached to a vessel upon which said hydraulic thruster for vessel is mounted.

9. A hydraulic thruster for vessel comprising a housing tiltably attached to a bracket, a cylinder rigidly attached to said housing, a tube slidably and rotationally disposed within said cylinder, a thrust means at a lower end of said tube, means of tilting said housing relative to said bracket, means of extending and retracting said tube relative to said cylinder, and means of rotating said tube relative to said cylinder, whereby said thrust means may be steered, said means of rotating said tube relative to said cylinder comprising a steering motor mounted to said housing, a steering motor gear driven by said steering motor, a tube gear driven by said steering motor gear, a tube gear clamp rigidly attached to said tube gear and releasably attached to said tube, means of releasing an attachment between said tube gear clamp and said tube whereby when said tube gear clamp is released said tube is free to reciprocate within said tube gear clamp, and means of maintaining an angular relationship between said tube and said steering clamp.

10. The hydraulic thruster for vessel of claim 9 wherein said means of releasing an attachment between said tube gear clamp and said tube comprises a tube gear clamp first half and a tube gear clamp second half defining a tube gear clamp bore, said tube gear second half being rigidly attached to said tube gear, one end of said tube gear clamp first half being attached to one end of said tube gear clamp second half, and a tube gear clamp actuator connecting the other ends of said tube gear clamp first half and said tube gear clamp second half, whereby when said tube gear clamp actuator allows the ends of said tube gear clamp first half and said tube gear clamp second half to which it is attached to separate, said tube is free to reciprocate within said tube gear clamp bore, and when said tube gear clamp actuator holds the ends of said tube gear clamp first half and said tube gear clamp second half to which it is attached in close mutual proximity, said tube gear clamp clamps onto said tube, thereby preventing said tube from reciprocating within said tube clamp bore.

11. The hydraulic thruster for vessel of claim 10 wherein said means of maintaining an angular relationship between said tube and said steering clamp comprises a tube gear clamp key extending into said tube gear clamp bore, and a tube keyway longitudinally disposed on said tube, said tube keyway being sized to slidably admit said tube gear clamp key, said tube gear clamp key traveling within said tube keyway when said tube extends or retracts relative to said cylinder.

12. The hydraulic thruster for vessel of claim 11 further comprising at least one extension actuator attached at one end to said cylinder and at an opposite end to a collar having a collar bore sized to slidably admit said tube, an end of said tube opposite said thrust means being disposed within said collar bore, a swivel union comprising a swivel union stationary section and a swivel union rotating section, said swivel union rotating section being attached to an end of said tube opposite said thrust means, and means to prevent said swivel union stationary section from rotating relative to said cylinder, said housing, and said bracket.

13. The hydraulic thruster for vessel of claim 12 wherein said means to prevent said swivel union stationary section from rotating relative to said cylinder, said housing, and said bracket comprises an anti-rotation member rigidly attached to said swivel union stationary section; and at least one anti-rotation member guide sized to slidably admit said anti-rotation member rigidly attached to said housing, said anti-rotation member reciprocating within said at least one anti-rotation member guide as said tube extends and retracts relative to said cylinder.

14. A hydraulic thruster for vessel comprising a housing tiltably attached to a bracket, a cylinder rigidly attached to said housing, a tube slidably and rotationally disposed within said cylinder, a thrust means at a lower end of said tube, means of tilting said housing relative to said bracket, means of extending and retracting said tube relative to said cylinder, and means of rotating said tube relative to said cylinder, whereby said thrust means may be steered;

said bracket comprising a first bracket side and a second bracket side mutually attached by a bracket front brace, at least one bracket floor brace attached to ends of said bracket sides opposite said housing, a bracket pivot point at an end of each said bracket side opposite said bracket front brace, and a stop rigidly attached to each bracket side between said bracket pivot point and said bracket front brace, said housing being tiltably attached to said bracket at said bracket pivot points, each said stop extending downwards from its respective said bracket side in a direction substantially perpendicular to said bracket side.

15. The hydraulic thruster for vessel of claim 14 wherein said housing comprises a housing roof, a first housing side, a second housing side, a housing floor, a cylinder aperture in said housing roof, and a cylinder aperture in said housing floor, each said cylinder aperture being sized to admit said cylinder, said cylinder being disposed through said cylinder apertures, an upper edge of said first housing side being attached along one edge of said housing roof, an upper edge of said second housing side being attached along an edge of said housing roof opposite said first housing side, a lower edge of said first housing side being attached along one edge of said housing floor, a lower edge of said second housing side being attached along an edge of said housing floor opposite said first housing side.

16. The hydraulic thruster for vessel of claim 15 wherein said means of tilting said housing relative to said bracket comprises a tilt arm rigidly attached to an end of at least one said housing side opposite said bracket, said tilt arm extending upwards and substantially perpendicular to an upper edge of said housing side to which it is attached; one bracket tilt actuator attach point on said bracket corresponding to each said tilt arm; and a tilt actuator, one end of said tilt actuator being rotatably attached to said bracket tilt actuator attach point, an opposite end of said tilt actuator being rotatably attached to an end of said tilt arm opposite said housing.

17. The hydraulic thruster for vessel of claim 16 further comprising redundant down-stop means, said down-stop means comprising a down-stop tab rigidly attached to each said housing side, said housing being tiltably attached to said bracket at a housing pivot point at an end of each said housing side closest said bracket, each said down-stop tab being disposed between said housing pivot point and an end of said housing side opposite said bracket, whereby each said down-stop tab butts against a respective said bracket side when said housing is fully tilted down relative to said bracket, and wherein an edge of said housing floor and lower edges of each said housing wall nearest said bracket butt against said stops when said housing is fully tilted down.

18. The hydraulic thruster for vessel of claim 16 wherein said means of extending said tube relative to said cylinder comprises a pair of extension actuators attached at one end to said cylinder and at an opposite end to a collar having a collar bore sized to slidably admit said tube, an extension actuator aperture in said housing roof, and an extension actuator aperture disposed in said housing floor, each said extension aperture being sized to admit one said extension actuator, at least one said extension actuator extending through said housing floor extension actuator aperture and said housing roof extension actuator aperture whereby said extension actuator is supported by said extension actuator apertures, an end of said tube opposite said thrust means being disposed within said collar bore.

19. The hydraulic thruster for vessel of claim 18 wherein said means of tilting said housing relative to said bracket comprises a tilt arm rigidly attached to at an end of each said housing side opposite said bracket, each said tilt arm extending upwards and substantially perpendicular to an upper edge of said housing side to which it is attached; one bracket tilt actuator attach point on said bracket corresponding to each said tilt arm; and a tilt actuator corresponding to each said tilt arm, one end of each said tilt actuator being rotatably attached to one said bracket tilt actuator attach point, an opposite end of each said tilt actuator being rotatably attached to an end of a corresponding said tilt arm opposite said housing.

20. The hydraulic thruster for vessel of claim 19 wherein said means of rotating said tube relative to said cylinder comprises a steering motor mounted to said housing, steering motor gear driven by said steering motor, a tube gear driven by said steering motor gear, a tube gear clamp rigidly attached to said tube gear and releasably attached to said tube, means of releasing an attachment between said tube gear clamp and said tube whereby when said tube gear clamp is released said tube is free to reciprocate within said tube gear clamp, and means of maintaining an angular relationship between said tube and said steering clamp.

21. The hydraulic thruster for vessel of claim 20 wherein said means of releasing an attachment between said tube gear clamp and said tube comprises a tube gear clamp first half and a tube gear clamp second half defining a tube gear clamp bore, said tube gear second half being rigidly attached to said tube gear, one end of said tube gear clamp first half being attached to one end of said tube gear clamp second half, and a tube gear clamp actuator connecting the other ends of said tube gear clamp first half and said tube gear clamp second half, whereby when said tube gear clamp actuator allows the ends of said tube gear clamp first half and said tube gear clamp second half to which it is attached to separate, said tube is free to reciprocate within said tube gear clamp bore, and when said tube gear clamp actuator holds the ends of said tube gear clamp first half and said tube gear clamp second half to which it is attached in close mutual proximity, said tube gear clamp clamps onto said tube, thereby preventing said tube from reciprocating within said tube clamp bore.

22. The hydraulic thruster for vessel of claim 21 wherein said means of maintaining an angular relationship between said tube and said steering clamp comprises a tube gear clamp key extending into said tube gear clamp bore, and a tube keyway longitudinally disposed on said tube, said tube keyway being sized to slidably admit said tube gear clamp key, said tube gear clamp key traveling within said tube keyway when said tube extends or retracts relative to said cylinder.

23. The hydraulic thruster for vessel of claim 22 further comprising at least one extension actuator attached at one end to said cylinder and at an opposite end to a collar having a collar bore sized to slidably admit said tube, an end of said tube opposite said thrust means being disposed within said collar bore, a swivel union comprising a swivel union stationary section and a swivel union rotating section, said swivel union rotating section being attached to an end of said tube opposite said thrust means, and means to prevent said swivel union stationary section from rotating relative to said cylinder, said housing, and said bracket.

24. The hydraulic thruster for vessel of claim 23 wherein said means to prevent said swivel union stationary section from rotating relative to said cylinder, said housing, and said bracket comprises an anti-rotation member rigidly attached to said swivel union stationary section; and at least one anti-rotation member guide sized to slidably admit said anti-rotation member rigidly attached to said housing, said anti-rotation member reciprocating within said at least one anti-rotation member guide as said tube extends and retracts relative to said cylinder.

25. A hydraulic thruster for vessel comprising a housing tiltably attached to a bracket, a cylinder rigidly attached to said housing, a tube slidably and rotationally disposed within said cylinder, a thrust means at a lower end of said tube, means of tilting said housing relative to said bracket, means of extending and retracting said tube relative to said cylinder, and means of rotating said tube relative to said cylinder, whereby said thrust means may be steered, a length said cylinder being substantially 28%-48% of a length of said tube, a height of said housing being substantially 5%-20% of said length of said tube, said means of extending said tube relative to said cylinder comprising at least one extension actuator attached at one end to said cylinder and at an opposite end to a collar having a collar bore sized to slidably admit said tube, a retracted length of each said at least one extension actuator being 26%-46% said length of said tube.

26. A method of removably attaching a hydraulic thruster for vessel to a vessel deck comprising the steps of:

A. Providing a vessel having a vessel deck;

B. Providing a hydraulic thruster for vessel comprising a housing tiltably attached to a bracket having a bracket floor brace with bracket floor brace bore, a weld tab having a weld tab threaded bore, a weld tab fastener sized to fit through said bracket floor brace bore and mate with said tab threaded bore, a cylinder rigidly attached to said housing, a tube slidably and rotationally disposed within said cylinder, a thrust means at a lower end of said tube, means of tilting said housing relative to said bracket, means of extending and retracting said tube relative to said cylinder, and means of rotating said tube relative to said cylinder;

C. Attaching said weld tab to said bracket floor brace by inserting said weld tab fastener through said bracket floor brace bore, and threading and tightening said weld tab fastener into said weld tab threaded bore;

D. Positioning said hydraulic thruster for vessel on said vessel deck as desired; and E. Attaching said weld tab to said vessel deck.

27. The method of removably attaching a hydraulic thruster for vessel to a vessel deck of claim 26 comprising the further steps of:

F. Unscrewing said weld tab fastener from said weld tab threaded bore, and removing said weld tab fastener from said weld tab threaded bore and from said floor brace bore; and G. Removing said hydraulic thruster for vessel from said vessel deck.

28. The method of removably attaching a hydraulic thruster for vessel to a vessel deck of claim 27 comprising the further steps of:

H. Positioning said hydraulic thruster for vessel on said vessel deck so said bracket floor brace bore aligns with said weld tab threaded bore; and I. Re-attaching said hydraulic thruster for vessel to said vessel deck by inserting said weld tab fastener through said bracket floor brace bore, and threading and tightening said weld tab fastener into said weld tab threaded bore.

29. The method of removably attaching a hydraulic thruster for vessel to a vessel deck of claim 28 comprising the further step of attaching said weld tab to said vessel deck by welding.

30. A hydraulic thruster for vessel comprising a housing tiltably attached to a bracket; a cylinder rigidly attached to said housing; said cylinder extending completely through said housing; a tube slidably and rotationally disposed within said cylinder; a thrust means at a lower end of said tube; means of tilting said housing relative to said bracket; means of extending and retracting said tube relative to said cylinder; and means of rotating said tube relative to said cylinder, whereby said thrust means may be steered.

31. The hydraulic thruster for vessel of claim 30 wherein said tube extends completely through said housing.

32. The hydraulic thruster for vessel of claim 31 wherein a length said cylinder is substantially 28%-48% of a length of said tube, and a height of said housing is substantially 5%-20% of said length of said tube.

* * * * *